US010894645B2

(12) United States Patent
Vagnoni et al.

(10) Patent No.: US 10,894,645 B2
(45) Date of Patent: Jan. 19, 2021

(54) ELONGATED TOOL HANG TAG PACKAGE WITH BRIDGE STRAP

(71) Applicant: Robert Bosch GmbH, Stuttgart (DE)

(72) Inventors: Adrian Vagnoni, Arlington Heights, IL (US); Rick McPhee, Lincolnton, NC (US); Scott Batz, Denver, NC (US); Randy Oliver, Johnson City, TN (US); Asmus Mueller, Bettlach (CH)

(73) Assignees: Robert Bosch Tool Corporation, Broadview, IL (US); Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/289,772

(22) Filed: Mar. 1, 2019

(65) Prior Publication Data

US 2020/0277117 A1 Sep. 3, 2020

(51) Int. Cl.
*B65D 73/00* (2006.01)

(52) U.S. Cl.
CPC ..... *B65D 73/0014* (2013.01); *B65D 73/0064* (2013.01)

(58) Field of Classification Search
USPC ..... 206/349, 379, 446, 806
See application file for complete search history.

(56) References Cited

U.S. PATENT DOCUMENTS 5,123,686 A 6/1992 Wenk
6,540,073 B1 * 4/2003 Hagel ..... B65D 75/305 206/379
6,902,064 B2 * 6/2005 Wang ..... A45C 11/24 206/379
7,005,989 B2 2/2006 Benoit et al.
7,175,151 B2 2/2007 Chang
7,210,663 B2 5/2007 Wheeler et al.
7,416,082 B2 8/2008 Roesler
7,614,498 B2 * 11/2009 O'Keefe ..... B65D 75/366 206/459.5

(Continued)

FOREIGN PATENT DOCUMENTS

DE 8810820 U1 10/1988
DE 202012000372 U1 4/2013
GB 2316929 A 3/1998

OTHER PUBLICATIONS

"Ace Hardware T5 Precision Screwdriver Hang Tag", retrieved from Internet at least as early as Aug. 24, 2018.

(Continued)

*Primary Examiner* — Jacob K Ackun
(74) *Attorney, Agent, or Firm* — Maginot, Moore & Beck LLP

(57) ABSTRACT

A hang tag package in one embodiment includes a base portion including an upper mounting portion, a first display portion located beneath the mounting portion and including a first window through which a tip portion of an elongated tool is viewable from the front of the base portion, and a body portion located beneath the display portion, the body portion including at least one integrally formed first welding pad. The hang tag package further includes a bridge strap including at least one integrally formed second welding pad ultrasonically welded to the integrally formed first welding pad whereby the elongated tool is entrapped between the body portion and the bridge strap.

20 Claims, 5 Drawing Sheets

(56) References Cited

U.S. PATENT DOCUMENTS

| | | | | |
|---|---|---|---|---|
| 7,624,865 | B2 | 12/2009 | Pendergraph et al. | |
| 10,000,322 | B2 | 6/2018 | Nowacki et al. | |
| 2004/0124106 | A1 | 7/2004 | Chen | |
| 2007/0138043 | A1* | 6/2007 | Roesler | B25H 3/003 206/379 |
| 2007/0228240 | A1 | 10/2007 | Kao | |
| 2012/0234709 | A1 | 9/2012 | Chang | |
| 2013/0270136 | A1* | 10/2013 | Pendergraph | B65B 9/045 206/349 |
| 2016/0023829 | A1* | 1/2016 | Pendergraph | B65B 9/045 206/349 |
| 2017/0073152 | A1 | 3/2017 | Sohler et al. | |
| 2018/0002088 | A1 | 1/2018 | Nowacki et al. | |
| 2018/0354693 | A1 | 12/2018 | Vagnoni et al. | |

OTHER PUBLICATIONS

"Wera 05100075001 917 SPH PH 1 X 80 MM Hang Tag S/Driver for Phillips Screws", retrieved from Internet at least as early as Aug. 24, 2018.

"Milwaukee SDS Max 4-Cutter Carbide Tip Hang Tag", photograph obtained at least as early as Aug. 24, 2018.

* cited by examiner

ELONGATED TOOL HANG TAG PACKAGE WITH BRIDGE STRAP

FIELD

This disclosure relates generally to product display packages and, more particularly, to a hang tag for elongated tools such as drill bits.

BACKGROUND

Unless otherwise indicated herein, the materials described in this section are not prior art to the claims in this application and are not admitted as prior art by inclusion in this section.

There are a variety of display packages designed for presenting relatively small products that are sold at retail as well as other stores, where the products are conveniently placed on rods or hooks that extend from a wall or display case. These display packages are commonly known as clip or hang tags which are designed to hold the product and provide a surface for an information label while providing an aperture which allows the hang tag to be hung on the outwardly extending rod or hook.

Drill bits and other elongated tools have been displayed using hang tags. In order to maximize the amount of drill bits that can be displayed in a given volume, it is desirable to reduce the size of the hang tags. Accordingly, relatively thin, elongated hang tags have been designed which have a mounting aperture at the upper end, an intermediate area on which labels can be placed, and a lower portion adapted to receive and hold the product, such as a drill bit, screwdriver and other tools.

A significant concern, particularly with drill bits which can be expensive relative to other similarly sized products, is shoplifting by customers who simply walk out of a retail establishment with the product. In response to this issue, security tags are often placed on the hang tags. Another concern with regard to drill bits is that customers have been known to switch the hang tag of an expensive drill bit with the hang tag of a less expensive drill bit.

Accordingly, it would be beneficial if a hang tag package could protect a tool such as a drill bit and provide for informational display and mounting while reducing the overall size of the package and product. It would be further beneficial if a hang tag were more difficult to disassemble the hang tag package from known hang tag packages to prevent removal of the product prior to sale and/or to hinder switching of hang tags.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In accordance with one embodiment, a hang tag package includes a base portion including an upper mounting portion, a first display portion located beneath the mounting portion and including a first window through which a tip portion of an elongated tool is viewable from the front of the base portion, and a body portion located beneath the display portion, the body portion including at least one integrally formed first welding pad. The hang tag package further includes a bridge strap including at least one integrally formed second welding pad ultrasonically welded to the integrally formed first welding pad whereby the elongated tool is entrapped between the body portion and the bridge strap.

In one or more embodiments, the hang tag package further includes an adhesive adhered to at least one anchoring structure of the base portion and to the elongated tool thereby adhering the elongated tool to the base portion.

In one or more embodiments, the body portion further includes a second window and the elongated tool is aligned with the second window such that a portion of the elongated tool is visible through the body portion from the front of the body portion.

In one or more embodiments the bridge strap includes at least one neck extending partially about the elongated tool.

In one or more embodiments the at least one neck is shaped complementary to a facing portion of the elongated tool.

In one or more embodiments the body portion includes side panels extending along the sides of the second window. Each side panel includes one of the first welding pads to which the second welding pads are ultrasonically welded.

In one or more embodiments, the body portion includes an anti-walking ridge associated with each welding pad, wherein the anti-walking ridges are configured to restrict movement of the bridge strap with respect to the body portion during an ultrasonic welding operation.

In one or more embodiments the two side panels are not co-planar.

In one or more embodiments the bridge strap includes an upper neck extending partially about the elongated tool and a lower neck extending partially about the elongated tool. A backing extends between the upper neck and the lower neck and is aligned with the second window.

In one or more embodiments, the bridge strap further includes a rib extending alongside the backing and spaced apart from the backing. The hang tag package further includes a label including a first end portion attached to the rib, the label extending from the first rib, around a front side of the body portion, over the backing, and to the rib whereat a second end portion of the label is attached to the first end portion of the label.

In one or more embodiments at least one of the upper neck and the lower neck is configured to closely conform to the elongated tool such that rotation of the elongated tool with respect to the at least one of the upper neck and the lower neck is inhibited.

In accordance with one embodiment, a method of forming a hang tag package includes providing a base portion including an upper mounting portion, a first display portion located beneath the mounting portion and including a first window, and a body portion located beneath the display portion, the body portion including at least one integrally formed first welding pad. The method includes positioning an elongated tool on a backside of the base portion such that a tip portion of the elongated tool is viewable from the front of the base portion through the first window. Then a bridge strap is ultrasonically welded to the body portion by ultrasonically welding at least one integrally formed second welding pad of the bridge strap to the at least one integrally formed first welding pad thereby entrapping the elongated tool between the body portion and the bridge strap.

In one or more embodiments, the method includes adhering at least one anchoring structure of the base portion to the elongated tool with an adhesive thereby adhering the elongated tool to the base portion.

In one or more embodiments of the method positioning the elongated tool on the backside of the base portion further includes aligning the elongated tool with a second window of the base portion such that a portion of the elongated tool is visible through the body portion from the front of the body portion.

In one or more embodiments the method includes positioning at least one neck of the bridge strap partially about the elongated tool prior to ultrasonically welding the bridge strap to the body portion.

In one or more embodiments of the method positioning the at least one neck of the bridge strap partially about the elongated tool includes positioning at least one neck of the bridge strap partially about a complementarily shaped facing portion of the elongated tool.

In one or more embodiments of the method providing the base portion includes providing a body portion which includes a first side panel extending along a first side of the second window, and a second side panel extending along a second side of the second window. The at least one integrally formed first welding pad includes a first side welding pad integrally formed with the first side panel and the at least one integrally formed first welding pad includes a second side welding pad integrally formed with the second side panel. Additionally, the at least one integrally formed second welding pad includes a third welding pad integrally formed with the bridge strap and the at least one integrally formed second welding pad includes a fourth welding pad integrally formed with the bridge strap. Accordingly, ultrasonically welding the bridge strap to the body portion includes ultrasonically welding the third welding pad to the first side welding pad and ultrasonically welding the fourth welding pad to the second side welding pad.

In one or more embodiments of the method the first side panel is not co-planar with the second side panel.

In one or more embodiments the method includes positioning an upper neck of the bridge strap partially about the elongated tool prior to ultrasonically welding the bridge strap to the body portion, positioning a lower neck of the bridge strap partially about the elongated tool prior to ultrasonically welding the bridge strap to the body portion, and aligning a backing of the bridge strap with the second window, the backing extending between the upper neck and the lower neck.

In one or more embodiments of the method at least one of the upper neck and the lower neck is configured to closely conform to the elongated tool such that rotation of the elongated tool with respect to the at least one of the upper neck and the lower neck is inhibited.

BRIEF DESCRIPTION OF THE DRAWINGS

These and other features, aspects, and advantages of this disclosure will become better understood when the following detailed description of certain exemplary embodiments is read with reference to the accompanying drawings in which like characters represent like parts throughout the drawings, wherein.

DETAILED DESCRIPTION

The following description is presented to enable any person skilled in the art to make and use the described embodiments, and is provided in the context of a particular application and its requirements. Various modifications to the described embodiments will be readily apparent to those skilled in the art, and the general principles defined herein may be applied to other embodiments and applications without departing from the spirit and scope of the described embodiments. Thus, the described embodiments are not limited to the embodiments shown, but are to be accorded the widest scope consistent with the principles and features disclosed herein.

Figure 1:
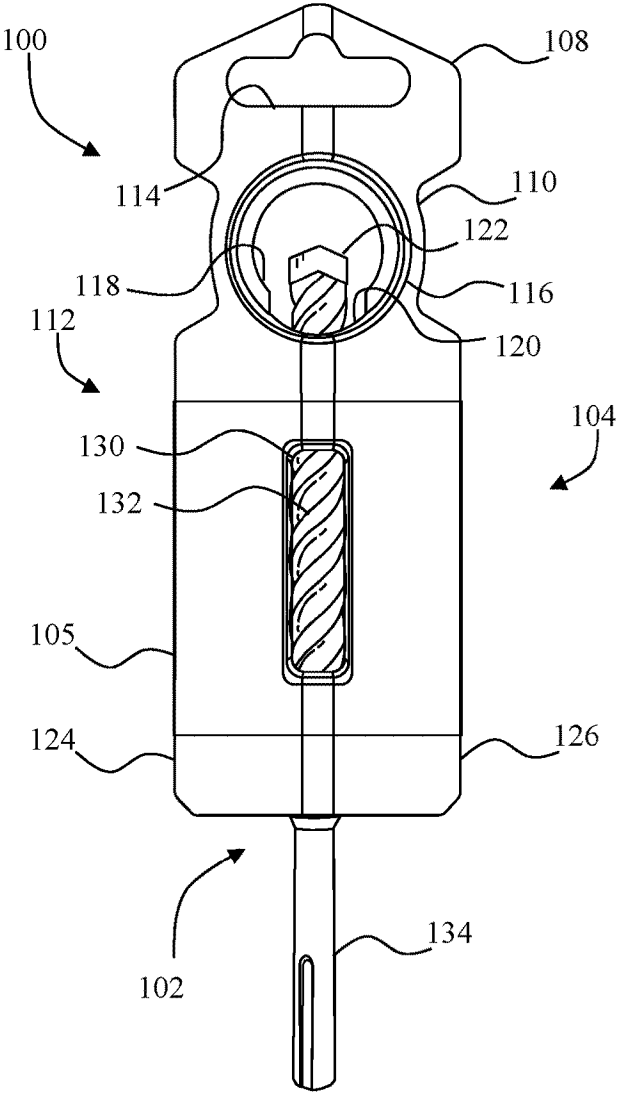
FIG. 1 depicts a front plan view of a hang tag package incorporating features of the disclosure.

FIG. 1 depicts a product display package 100 which in this embodiment is a hang tag package including a drill bit 102. In other embodiments, other elongated products are displayed by the hang tag package 100 such as screw drivers, chisels, etc. The hang tag package 100 includes a base portion 104, a label 105, and a bridge strap 106 shown in FIG. 2. The base portion 104 includes an upper mounting portion 108, a display portion 110, and a body portion 112.

The upper mounting portion 108 includes a mounting window 114 which in the embodiment of FIG. 1 is fully encircled but in other embodiments is open to one side. The mounting window 114 is configured to be used when mounting the hang tag package 100 for display using, for example, a peg, clip, or other device whereby the hang tag package 100 hangs from the upper mounting portion 108. The position of the mounting portion 108 allows an elongated tool such as the drill bit 102 to be mounted with its tip facing upwardly for ease of inspection by a customer without requiring removal of the hang tag package from the display.

The display portion 110 is located immediately below the upper mounting portion 108 and includes a display window 116 and a backwardly extending lip 118. The lip 118 includes a mouth 120 through which a tip 122 of the drill bit 102 extends. The display window 116, which in this embodiment is fully encircled but in other embodiments is open to one of the sides of the hang tag package 100, allows a customer to see the tip 122 of the drill 102.

Figure 3:
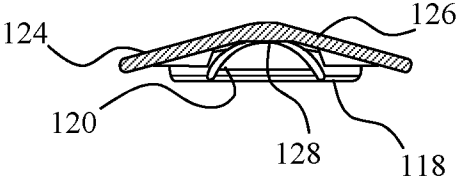
FIG. 3 depicts a cross-sectional view of the base portion of the hang tag package of FIG. 1.

The body portion 112 is located immediately beneath the display portion 110 and includes two side panels 124 and 126. As shown more clearly in FIG. 3, the side panels 124 and 126 are angled with respect to one another so that they are not coplanar. This provides additional rigidity to the hang tag package. Since the label 105 is affixed to the side panels, the angled configuration provides greater visibility for a wider label viewing angle.

The angled configuration further provides for centering of the drill bit 102 on the body portion 112 and aligns the drill bit 102 with both the display window 116 and a display window 130 in the body portion 112 in embodiments including the display window 130. Accordingly, since the mouth 120 allows the drill bit 102 to be positioned directly against the backside 128 (see FIG. 3) of the body portion 112, the side panels cover a portion of the drill bit 102 when the hang tag package is viewed from the side.

Returning to FIG. 1, the display window 130 allows a customer to see the fluted portion 132 of the drill bit 102 from the front of the hang tag package 100 in embodiments including the display window 130. In some embodiments, the display window 130 is omitted. The body portion 112 is sized so that when the hang tag package 100 is hung, the handle of the elongated tool, or in the case of the drill bit 102, the shank 134, extends beneath the body portion 112. Accordingly, a customer can see all of the relevant portions of the drill bit 102. Moreover, the customer can test fit the shank of the drill bit 102, or other elongated tool, into another tool without removing the elongated tool from the rest of the hang tag package.

Figure 4:
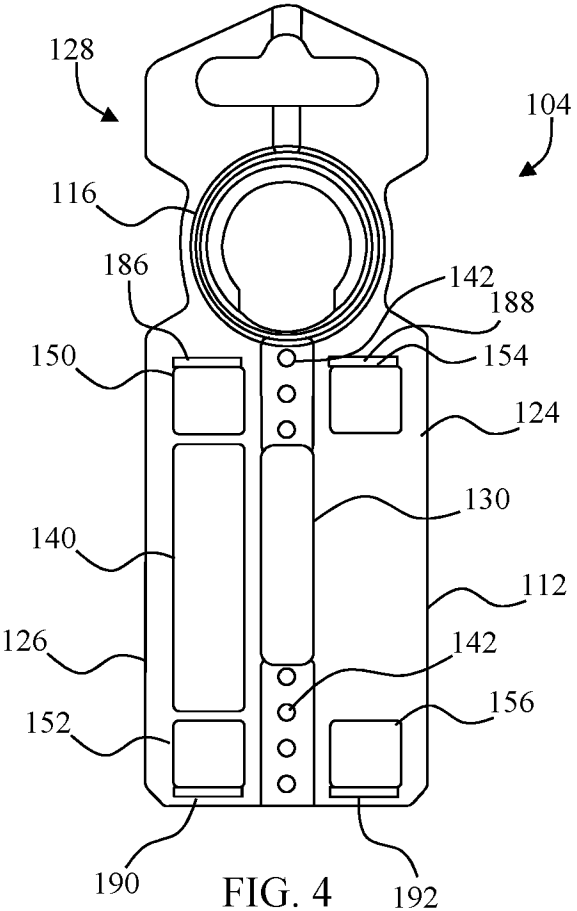
FIG. 4 depicts a plan view of the backside of the base portion of the hang tag package of FIG. 1.

FIG. 4 shows the backside 128 of the base portion 104. In this embodiment, the body portion 112 includes a depression 140 which has a flat surface, along with a number of anchoring structures 142. The anchoring structures 142, which in various embodiments are boss structures or debossed structures, in this embodiment are circular and are used with an adhesive 144 shown in FIG. 2 to inhibit removal of the drill bit 102 from the hang tag. Anchoring structures in some embodiments are provided additionally or alternatively on the elongated tool.

In some embodiments, the anchoring structures provide increased surface areas for the adhesive 144. The adhesive 144 engages the anchoring structures 142 and the drill bit 102 to inhibit rotation and/or removal of the elongated product from the hang tag package 100. In some embodiments, the elongated tool is provided with a debossed area which, along with the debossed structures 142, provides enhanced securement for the adhesive. When provided on the drill bit the debossed area in some embodiments is located beneath a flute.

In one embodiment, the adhesive is selected to act in a manner similar to a rubber cement. To wit, the adhesive acts substantially like a gasket which increases friction by remaining at least somewhat tacky rather than by providing an unbreakable connection with the elongated tool. The adhesive thereby resists rotation of the elongated tool while being easily removed from the elongated tool when the elongated tool is removed from the hang tag package. In one embodiment such an adhesive is commercially available from DHM Adhesives Inc. of Calhoun, Ga under the trade name DHM-798 which is a hot melt polyolefin based glue with excellent adhesion to plastics, fiberglass, metal, and most substrates.

Returning to FIG. 4, the backside of the base portion 104 further includes four welding pads 150, 152, 154, and 156. In one embodiment, the welding pads 150, 152, 154, and 156 are integrally formed with the body portion 112. The welding pads 150, 152, 154, and 156 are used to connect the base portion 104 to the bridge strap 106 which is shown in further detail in FIG. 5.

The bridge strap 106 includes four integrally formed welding pads 158, 160, 162, and 164 which, as discussed in further detail below, are welded to the welding pads 150, 152, 154, and 156, respectively.

The bridge strap 106 further includes a backing portion 166 and two support ribs 168 and 170. The backing portion 166 traps the drill 102 and the underling adhesive 144 against the body portion 112. The welding pads 150, 152, 154, and 156 of the body portion 112 are configured such that when welded to the welding pads 158, 160, 162, and 164, the bridge strap 106 is aligned with the body portion 112. Hence, the backing portion 166 is aligned with the display window 130 in embodiments including the second window 130.

The support ribs 168 and 170 and the backing portion 166 are used to support the label 105 as described with reference to FIG. 6. The label 105 includes a first end portion 174, a front label portion 176, a window 178, a rear label portion 180, and a second end portion 182. The label 105 is attached to the base portion 104 and the bridge strap 106 by adhering the first end portion 174 to the support rib 170, wrapping the label 105 around the front of the base portion 104 and then over the support rib 168 and the backing portion 166, and adhering the second end portion 182 to the first end portion 174 at the rib 170.

The label 105 is configured such that when attached to the base portion 104 and the bridge strap 106, the window 178 is aligned with the display window 130 with the front label portion 176 centered about the display window 130 in embodiments including the display window 130. In any event, the front label portion 176 extends over at least a portion of each of the side panels 124/126. Additionally, the rear label portion 180 is centered on the backing portion 166. Accordingly, the front label portion 176 is clearly visible to provide detailed information regarding the elongated tool to a consumer while the hang tag package 100 is on display, and the rear label portion is available for additional information such as warning information and coding labels.

Since the label 105 is overlapped at the rib 170, none of the writing or illustrations on the label will mismatch in a critical area. Moreover, the label 105 conceals the security tag 184 positioned within the depression 140. Because of the ribbed structure of the bridge strap 106, a lesser amount of materials is required thereby lowering costs and weight of the hang tag package 100. The material used for the label is selected to provide puncture resistance so that consumers do not puncture the label 105 when handling the hang tag 100. To this end, in one embodiment, the label 105 is formed using 60 # bi-orientated polypropylene (BOPP).

Figures 6, 7, 8:
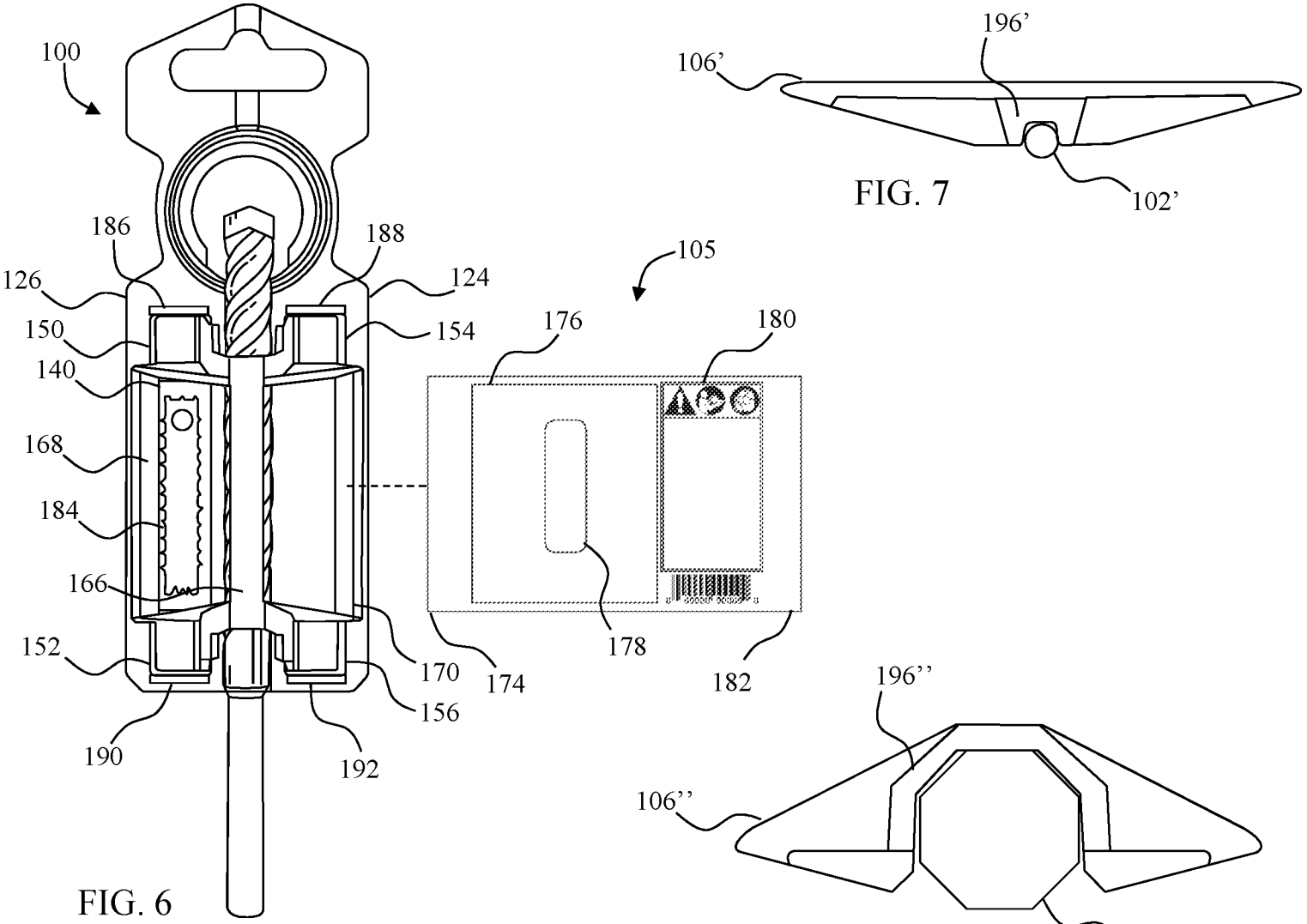
FIG. 6 depicts a partially exploded plan view of the backside of the hang tag package of FIG. 1.
FIG. 7 depicts a bottom plan view of a bridge strap and elongated tool wherein the neck of the bridge strap is complementarily sized for the facing portion of the elongated tool.
FIG. 8 depicts a plan view of a bridge strap wherein the neck of the bridge strap is sized and shaped to closely conform to the facing portion of the elongated tool.

Also shown in FIG. 6 are upper anti-walking ridges 186 and 188 and lower anti-walking ridges 190 and 192. The anti-walking ridges 186/188/190/192 are integrally formed with the base portion 104 and positioned immediately above (anti-walking ridges 186/188) or below (anti-walking ridges 190/192) an associated welding pad 150/152/154/156. The anti-walking ridges 186/188/190/192 extend away from the base portion 104 to a greater degree than the associated welding pad 150/152/154/156. While any desired shape can provide the function of the anti-walking ridges 186/188/190/192 which is discussed in more detail below, in one embodiment the anti-walking ridges 186/188/190/192 are identically shaped and sized and have the same shape and size as associated guide surfaces on the bridge strap 106.

Referring again to FIG. 5, two of the associated guide surfaces 194 are shown (the two associated with the welding pads 160/164 are not shown). Each guide surface 194 extends outwardly from the associated welding pad.

Figure 5:
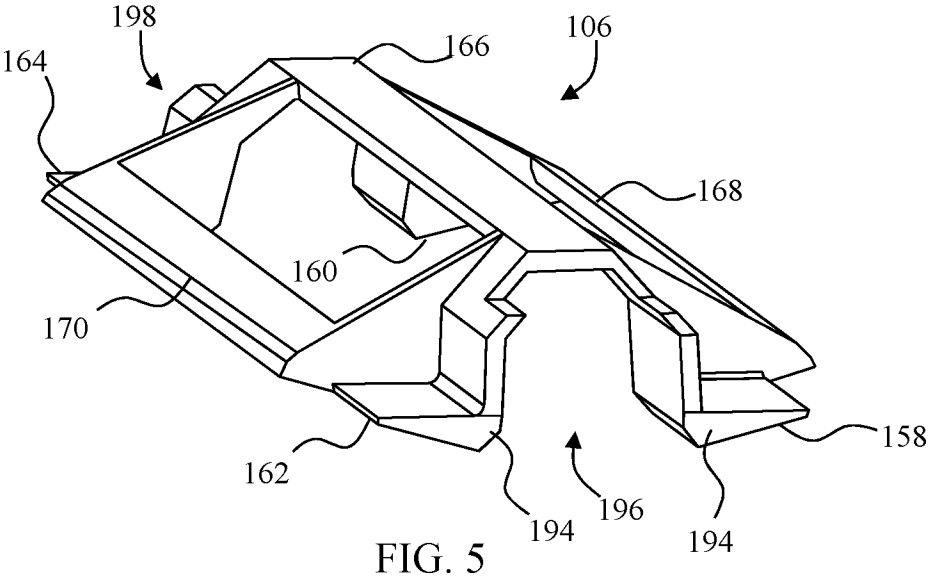
FIG. 5 depicts a perspective view of the bridge strap of the hang tag package of FIG. 1.

Continuing with FIG. 5, the bridge strap 106 further includes a neck 196 and a neck 198. The neck 196 and the neck 198, which in some embodiments are differently sized and/or shaped, are sized and shaped to allow the drill bit 102 to be positioned within the upper neck 196 and the lower neck 198 when the drill bit 102 is held against the body portion 112 by the bridge strap 166.

One or both of the neck 196 and the neck 198 is/are sized and shaped to conform to the size and shape of the drill bit 102 or other elongated tool to provide additional stability to the hang tag package. By way of example, FIG. 7 depicts a bridge strap 106' that is used with the base portion 104 of FIG. 1 which includes a neck 196' which is sized to provide three points of contact for the facing portion of a circularly shaped portion of an elongated tool 102'.

FIG. 8 depicts a bridge strap 106" that is used with the base portion 104 of FIG. 1 which includes a neck 196" which is sized to closely conform to the shape of the facing portion of an elongated tool 102". When an elongated tool has a non-circular shape, a closely conformed neck such as the neck 196" inhibits rotation of the elongated tool. This configuration is particularly advantageous when the elongated tool does not include an increased diameter portion which can be used to inhibit pulling the elongated tool out of the hang tag package.

The bridge strap 196" in some embodiments is incorporated with a base portion which includes a protuberance. By way of example, in embodiments wherein one or more of the anchoring structures 142 (see FIG. 4) is a bossed anchoring structure, and the elongated tool 102" is a drill bit, or tool including a groove or flute which extends axially and radially about the tool, the anchoring structure is configured to align with the flute. Accordingly, the anchoring structure 142 precludes simply pulling the elongated tool 102" out of the hang tag, while the neck 196" precludes rotation of the elongated tool to preclude "unscrewing" the elongated tool from the hang tag. Accordingly, the adhesive in some of these embodiments is omitted without enabling removal of the elongated tool. The flute thus acts as a debossed anchoring structure.

In some embodiments, the elongated tool is provided with a debossed anchoring structure/opening into which a bossed anchoring structure of the body portion 112 extends to inhibit or prevent relative movement between the elongated tool and the body portion 112. In some embodiments, the debossed anchoring structure and bossed anchoring structure only prevent pulling the elongated tool out of the hang tag, e.g., when the debossed anchoring structure is a flute. In other embodiments the debossed anchoring structure and bossed anchoring structure prevent pulling the elongated tool out of the hang tag and further prevent rotation of the elongated tool with respect to the body portion, e.g., when the debossed area does not extend axially along the shaft for a distance which allows pulling the elongated tool out of the hang tag.

Figure 9:
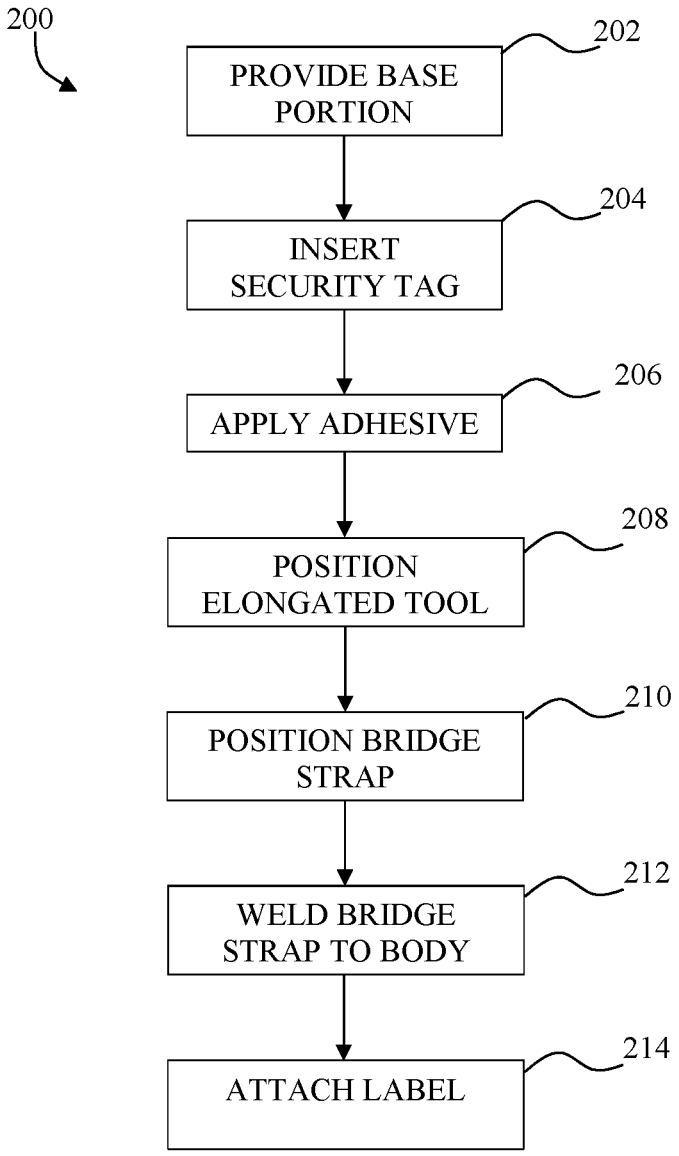
FIG. 9 depicts a process for assembling the hang tag package of FIG. 1.

The hang tag package 100 is assembled in one embodiment according to the method 200 of FIG. 9. While discussed with reference to the hang tag package of FIG. 1, the process is also used with the other embodiments described herein with such modifications as appropriate for the differences of the various embodiments. Moreover, in different embodiments one or more steps of the method 200 are omitted and or replaced, and the order of the steps modified. At block 202 the base portion 104 is provided. In one embodiment, the base portion 104 is made from a rigid plastic material, such as a thermoplastic polymer. In one embodiment, the base portion 104 includes high-density polyethylene (HDPE). Typically, the base portion 104 is manufactured via an injection molding process.

At block 204 the security tag 184 is affixed in the depression 140 in some embodiments. An adhesive is applied to the base portion 104 at block 206. In some embodiments, the adhesive is applied in depression 140 and the security tag is affixed in the depression 140 in a following step. Once the adhesive is applied, the elongated tool is inserted onto the body portion (and the adhesive). The angled side panels 124 and 126 help to align the elongated tool on the body portion 112. In embodiments including flutes or openings and protruding (bossed) anchoring structures 142, the anchoring structures 142 further assist in aligning the elongated tool on the body portion 112. Alignment of the elongated tool in some embodiments includes alignment of the elongated tool with one or more of the display windows 116 and 130.

The bridge strap 106 is then positioned on the body portion 112 (block 210). In particular, the bridge strap 106 is aligned with the body portion 112 by positioning the welding pads 158, 160, 162, and 164 of the bridge strap 106 on the welding pads 150, 152, 154, and 156 of the body portion 112. The anti-walking ridges 186/188/190/192 assist in aligning the bridge strap 106 as each of the guide surfaces 194 are positioned immediately adjacent an associated anti-walking ridge.

In order to achieve contact between the respective welding pads, the bridge strap 106 in some embodiments is flexed by forcing the welding pads of the bridge strap against the welding pads of the body portion thereby pressing the elongated tool against the body portion 112 with the backing portion 166.

At block 212 the bridge strap 106 is welded to the body portion 112. To this end one or more of the body portion welding pads and the bridge strap welding pads are provided in some embodiments with features, e.g., ridges, to assist in the welding process which in some embodiments is an ultrasonic welding process. The anti-walking ridges 186/188/190/192 interacting with the guide surface 194 prevent the bridge strap welding pads from moving off of the base portion welding pads during the welding process. The process ends at block 214 when a label 105 is attached to the welded bridge strap and body in the manner discussed above.

Figure 2:
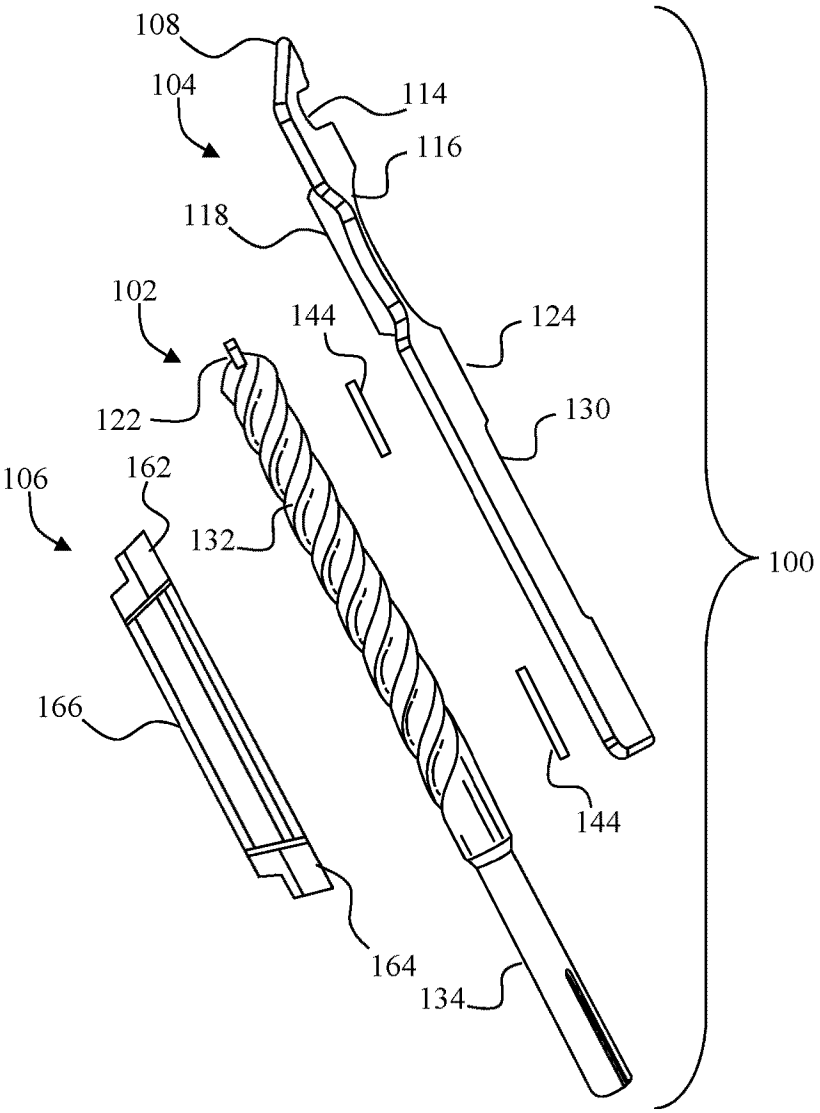
FIG. 2 depicts an exploded view of the hang tag package of FIG. 1 without the label.
Figure 10:
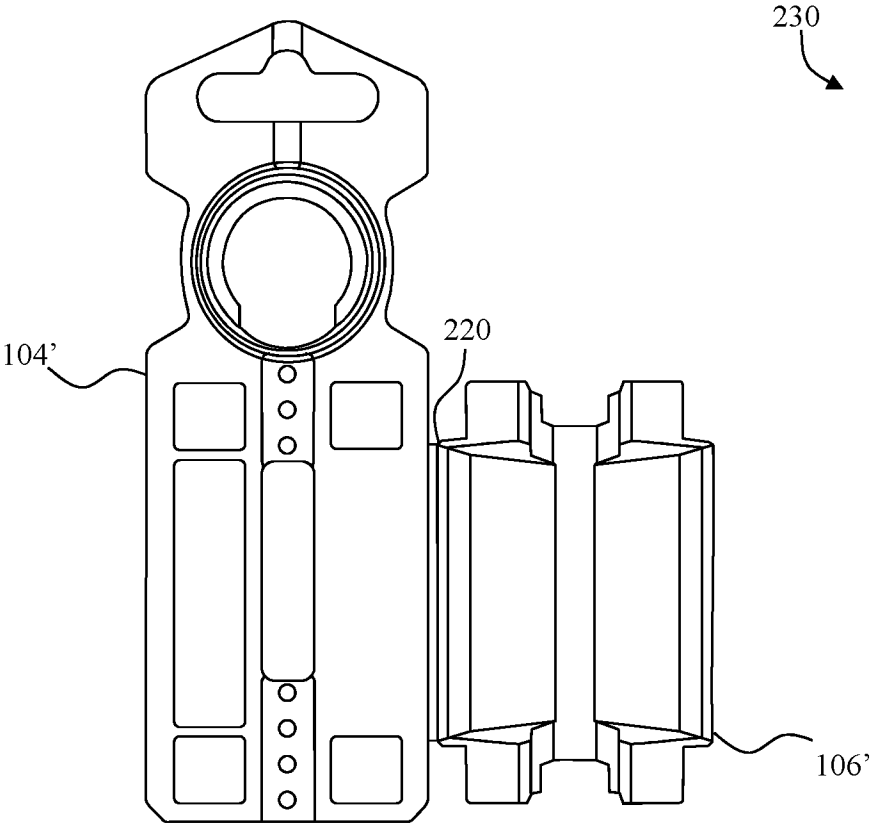
FIG. 10 depicts a molding of a base portion and a bridge strap wherein the base portion and the bridge strap are integrally formed.

While FIG. 2 shows the base portion 104 and the bridge strap 106 as separately formed components, in some embodiments the base portion and the bridge strap are integrally formed. By way of example, FIG. 10 shows the base portion 104' and the bridge strap 106' which have been formed as a single molding with a joiner strip 220. In some embodiments, the joiner strip 220 is severed prior to the process 200. In other embodiments, the bridge strap 106' is simply folded over the body portion 104' along the joiner strip 220 and then welded to the body 104' in the manner described above.

Figure 11:
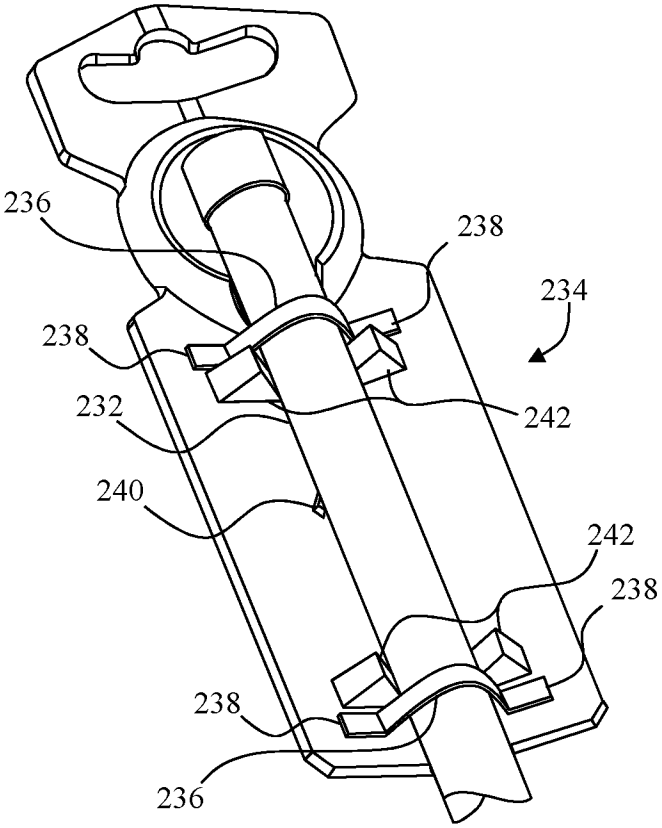
FIG. 11 depicts a hang tag package including a rib, two bridge straps, and two pairs of alignment guide structures which in some embodiments are incorporated into the hang tag package of FIG. 1.

FIG. 11 shows another embodiment of a hang tag package 230. The hang tag package 230 includes an elongated tool 232, a base portion 234 and two bridge straps 236. The bridge straps 236 include two welding pads 238 which are welded to the base portion 234.

The base portion 234 is similar to the base portion 104. Rather than a display window 130, however, the base portion 234 includes a rib 240 which is configured to be inserted within a flute (not shown) or opening (not shown) of the elongated tool 232. The rib 240 prevents the elongated tool 232 from being pulled out of the hang tag package 230. The base portion 234 further includes two pairs of alignment guides 242. The alignment guides 242 align the elongated tool 232 on the base portion 234 in preparation for ultrasonic welding of the bridge straps 236 to the base portion 234. In some embodiments, an adhesive is applied between the elongated tool and the alignment guides 242 to resist rotation. In some embodiments, one or more of the bridge straps 236, rib 240, and alignment guides 242 are incorporated into the base portion 104.

In the above embodiments, the hang tag package provides a number of advantages. The angled body portions provide enhanced strength and customer viewing. The hang tag package provides for viewing of both ends of the elongated tool and to the central portion of the elongated tool. The hang tag package further provides access to the shank of the elongated tool so a customer can verify compatibility of the elongated tool with other tools while preventing removal of the elongated tool prior within a retail facility. The hang tag package is easily assembled and does not incorporate small fasteners which can be difficult to control during assembly.

While the disclosure has been described with reference to various embodiments, it will be understood that these embodiments are illustrative and that the scope of the disclosure is not limited to them. Many variations, modifications, additions, and improvements are possible. More generally, embodiments in accordance with the patent have been described in the context or particular embodiments. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A hang tag package, comprising:

an elongated tool;

a base portion including an upper mounting portion, a first display portion located beneath the mounting portion and including a first window through the base portion and through which a tip portion of the elongated tool is viewable from a front side of the base portion, and a body portion located beneath the display portion, the body portion including at least one integrally formed first welding pad on a backside of the body portion; and a bridge strap including at least one integrally formed second welding pad ultrasonically welded to the at least one integrally formed first welding pad whereby the elongated tool is entrapped between the body portion and the bridge strap.

2. The hang tag package of claim 1, wherein:

the body portion includes a first side panel;

the body portion includes a second side panel extending along a side of the first side panel;

the at least one integrally formed first welding pad includes a first side welding pad integrally formed with the first side panel;

the at least one integrally formed first welding pad includes a second side welding pad integrally formed with the second side panel;

the at least one integrally formed second welding pad includes a third welding pad integrally formed with the bridge strap and ultrasonically welded to the first side welding pad; and the at least one integrally formed second welding pad includes a fourth welding pad integrally formed with the bridge strap and ultrasonically welded to the second side welding pad.

3. The hang tag package of claim 2, further comprising:

a first anti-walking ridge integrally formed with the first side panel at a location immediately adjacent to the first side welding pad;

a second anti-walking ridge integrally formed with the second side panel at a location immediately adjacent to the second side welding pad;

a first anti-walking ridge integrally formed with the first side panel at a location immediately adjacent to the first side welding pad;

a second anti-walking ridge integrally formed with the second side panel at a location immediately adjacent to the second side welding pad;

a first guide surface integrally formed with the bridge strap and positioned immediately adjacent to the first anti-walking ridge; and a second guide surface integrally formed with the bridge strap and positioned immediately adjacent to the second anti-walking ridge, wherein the first and second anti-walking ridges and the first and second guide surfaces are configured to restrict movement of the bridge strap with respect to the body portion during an ultrasonic welding operation.

4. The hang tag package of claim 3, wherein the bridge strap further comprises:

an upper neck extending partially about the elongated tool;

a lower neck extending partially about the elongated tool; and a backing extending between the upper neck and the lower neck and aligned with the second window.

5. The hang tag package of claim 4, wherein:

the bridge strap further comprises a rib extending alongside the backing and spaced apart from the backing; and the hang tag package further comprises a label including a first end portion attached to the rib, the label extending from the rib, around the front side of the body portion, over the backing, and to the rib whereat a second end portion of the label is attached to the first end portion of the label.

6. The hang tag package of claim 5, wherein:

the base portion includes at least one anchoring structure; and the hang tag package further comprises an adhesive adhered to the at least one anchoring structure and to the elongated tool thereby inhibiting relative movement between the elongated tool and the base portion.

7. The hang tag package of claim 6, wherein:

the body portion further comprises a second window located between the first side panel and the second side panel;

the label includes a label window aligned with the second window; and the elongated tool is aligned with the second window such that a portion of the elongated tool is visible through the body portion from the front side of the body portion, extending along a first side of the second window.

8. The hang tag package of claim 7, wherein at least one of the upper neck and the lower neck is shaped complementary to a facing portion of the elongated tool and configured to closely conform to a facing portion of the elongated tool such that rotation of the elongated tool with respect to the at least one of the upper neck and the lower neck is inhibited.

9. The hang tag package of claim 5, wherein:

the elongated tool includes a debossed anchoring structure; and the body portion includes a bossed anchoring structure configured to extend at least partially into the debossed anchoring structure such that the elongated tool cannot rotate with respect to the base portion.

10. A method of forming a hang tag package, comprising:

providing a base portion including an upper mounting portion, a first display portion located beneath the mounting portion and including a first window through the base portion, and a body portion located beneath the display portion, the body portion including at least one integrally formed first welding pad;

positioning an elongated tool on a backside of the base portion such that a tip portion of the elongated tool is viewable from a front side of the base portion through the first window; and ultrasonically welding a bridge strap to the body portion by ultrasonically welding at least one integrally formed second welding pad of the bridge strap to the at least one integrally formed first welding pad thereby entrapping the elongated tool between the body portion and the bridge strap.

11. The method of claim 10, further comprising, prior to ultrasonically welding the bridge strap to the body portion, positioning the bridge strap by:

positioning a first guide surface of the bridge strap immediately adjacent to a first anti-walking ridge integrally formed with a first side panel of the body portion, the first anti-walking ridge located immediately adjacent to a first of the at least one integrally formed first welding pads; and positioning a second guide surface of the bridge strap immediately adjacent to a second anti-walking ridge integrally formed with a second side panel of the body portion, the second anti-walking ridge located immediately adjacent to a second of the at least one integrally formed first welding pads.

12. The method of claim 11, wherein:

positioning the bridge strap includes positioning a backing of the elongated tool at least partially directly opposite the first side panel and at least partially directly opposite the second side panel, the method further comprising:

attaching a first end portion of a label to a rib of the bridge strap, the rib extending alongside the backing and spaced apart from the backing;

extending the label from the rib such that the label extends around the front side of the body portion and over the backing; and attaching a second end portion of the label to the first end portion of the label at the rib.

13. The method of claim 12, further comprising:

adhering at least one anchoring structure of the base portion to the elongated tool with an adhesive thereby inhibiting relative movement between the elongated tool and the base portion.

14. The method of claim 13, wherein positioning the elongated tool on the backside of the base portion further comprises:

aligning the elongated tool with a second window of the base portion such that a portion of the elongated tool is visible through the body portion from the front of the body portion.

15. The method claim 14, wherein positioning the bridge strap further includes:

positioning at least one neck of the bridge strap partially about the elongated tool prior to ultrasonically welding the bridge strap to the body portion.

16. The method of claim 15, wherein positioning the at least one neck of the bridge strap partially about the elongated tool comprises:

positioning at least one neck of the bridge strap partially about a complementarily shaped facing portion of the elongated tool.

17. The method of claim 12, wherein:

providing the base portion includes providing a body portion which includes the first side panel and the second side panel, the first side panel extending along a first side of a second window, and the second side panel extending along a second side of the second window;

the at least one integrally formed first welding pad includes a first side welding pad integrally formed with the first side panel;

the at least one integrally formed first welding pad includes a second side welding pad integrally formed with the second side panel;

the at least one integrally formed second welding pad includes a third welding pad integrally formed with the bridge strap;

the at least one integrally formed second welding pad includes a fourth welding pad integrally formed with the bridge strap; and ultrasonically welding the bridge strap to the body portion includes ultrasonically welding the third welding pad to the first side welding pad and ultrasonically welding the fourth welding pad to the second side welding pad.

18. The method of claim 17, wherein the first side panel is not co-planar with the second side panel.

19. The method of claim 12, further comprising:

positioning an upper neck of the bridge strap partially about the elongated tool prior to ultrasonically welding the bridge strap to the body portion;

positioning a lower neck of the bridge strap partially about the elongated tool prior to ultrasonically welding the bridge strap to the body portion; and aligning the backing of the bridge strap with the second window, the backing extending between the upper neck and the lower neck.

20. The method of claim 19, wherein at least one of the upper neck and the lower neck is configured to closely conform to a facing portion of the elongated tool such that rotation of the elongated tool with respect to the at least one of the upper neck and the lower neck is inhibited.

* * * * *